US005393243A

United States Patent [19]

Carmo

[11] Patent Number: 5,393,243

[45] Date of Patent: Feb. 28, 1995

[54] RELEASABLE CORD CONNECTING LOCK

[75] Inventor: Robert A. Carmo, Placentia, Calif.

[73] Assignee: Pacific Electricord Company, Gardena, Calif.

[21] Appl. No.: 224,894

[22] Filed: Apr. 8, 1994

[51] Int. Cl.[6] ..... H01R 13/62

[52] U.S. Cl. ..... 439/369

[58] Field of Search ..... 439/367, 368, 369, 370

[56] References Cited

U.S. PATENT DOCUMENTS

| | | | |
|---|---|---|---|
| 2,406,567 | 8/1946 | Schueneman | 439/369 |
| 2,753,536 | 7/1956 | Tjader | 439/369 |
| 2,903,669 | 9/1959 | Gilman et al. | 439/369 |
| 2,976,374 | 3/1961 | Poulsen . | |
| 3,383,639 | 5/1968 | Anderson et al. | 439/369 |
| 4,884,979 | 12/1989 | Budner | 439/369 |

*Primary Examiner*—Khiem Nguyen
*Attorney, Agent, or Firm*—Paul J. Sutton

[57] ABSTRACT

A plug and socket connector clamp for maintaining engagement between an electrical plug and mating socket connector. The clamp includes a housing having sides and end abutments defining a central space for receiving the mated plug and socket connector. The sides prevent sideways disconnection of the plug and socket connector in at least one plane. A first of the end abutments contains an electric cord retaining slot and is in intimate contact with one of the plug and socket connector. The second end abutment has a releasable member for the rapid installation and removal of a cord clamp which also includes a clamping portion arranged to be brought into intimate contact with the other of said plug or socket connector. The releasable cord clamp itself is made up of two hinged halves which can be rapidly installed to or removed from an electrical cord, making overall installation and removal of the clamp quick and simple.

10 Claims, 3 Drawing Sheets

RELEASABLE CORD CONNECTING LOCK

BACKGROUND OF THE INVENTION

1. Field of the Invention

The instant invention relates to an electrical plug and a mating electrical female or socket connector clamp for maintaining engagement between such plug and such socket connector, and more specifically, to such a clamp for accomplishing this without forcibly gripping or damaging the electrical cords associated with either.

2. The Prior Art

A portable electrical appliance such as a power saw, vacuum cleaner or the like is often used with an extension cord connected to the electrical cord of the appliance. The connected cords sometimes snag on obstructions during movement of the appliance and pull apart the connection between the plug of the appliance and the female or socket connector of the extension cord. Sometimes the plug and socket connector only partially separate, dangerously exposing portions of the plug contacts.

Various contrivances have been proposed for clamping together such a plug and female connector to prevent their inadvertent separation. These include the devices described in U.S. Pat. Nos. 2,753,536 (Tjader); 3,609,638 (Dany); 3,999,828 (Howell); and 4,221,449 (Shugart, Jr.), none of which satisfactorily prevents electrical connectors from being pulled apart.

The device described by Howell employs a friction clamp to frictionally grip the cord of a fitting, to retain the fitting in mating contact with a second fitting. However, such a friction clamp does not work reliably when the cord is wet or oily. Moreover, if such a clamp is used repeatedly on the same cord, the cord insulation is eventually damaged by the abrading action of the clamp.

The device described by Dany is adjustable only after removal from the cords being clamped. Further, it is characterized by protrusions that can snag on foreign objects, especially if the joined cords are dragged over rough ground.

The Shugart device is retained in position by the engagement under tension of a locking member having serrations. The Tjader device employs a spring clamp. Both devices are subject to abrupt disengagement if subjected to vibration or a sudden pull on the cords.

The Carmo device, U.S. Pat. No. 4,664,463 issued May 12, 1987 and assigned to the assignee of the instant invention, went a long way to eliminate the various problems noted above with respect to the prior art devices. It did, however, lack the ability to rapidly install or remove the clamping means from the electrical cord and the ability to rapidly remove or install the clamping means in the overall clamp. Normally the cord 16 would be fed through clamping means 30 and then the connector 14 could be installed to the cord 16 end or if the connector was molded with the cord, then the appliance could be installed at the free end of cord 16.

It is suggested at Column 5, line 12 et seq that clamping means 30 could be cut or slit along with end abutment boss 36 as shown at 58 of FIG. 1 so that connector 14 and cord 16 could be installed into clamping means 30 and boss 36 or removed therefrom. The limited flexibility of the clamp material is relied upon to prevent unwanted withdrawal of cord 16 and connector 30 but this limited flexibility must be relied on if the cord 16 and connector 14 are to be placed in the clamp. A very unsatisfactory approach. If the flexibility is low enough to retain cord 16 and connector 14, it will most likely be very difficult to get connector 14 and cord 16 into the clamp unless wedges are used, making the clamp very difficult to use.

The '463 patent described a plug and female connector clamp which securely maintains a plug and female or socket connector in mating contact without any necessity for forcibly gripping their cords. The clamp does not damage the insulation of the cords with repeated use and is not susceptible to failure under vibration, or as a result of sudden pulls on the plug and female connector cords. Further, its configuration reduces any tendency for it to snag on foreign objects.

The clamp comprises an elongated housing having spaced apart sides and end abutments defining a central space for receiving an engaged plug and female connector. The cords extending from the plug and female connector pass through openings in the end abutments. The cord 18 to plug 12 passes through deflecting arms 34 to a cord opening 32 making it relatively simple to install or remove cord 18.

However, it is difficult to install or remove cord 16 from clamping means 30 and boss 36. The cord 16 would have to be string through the clamping means 30 and boss 36 while at lease one end was unterminated, which makes it difficult to use a clamp of this type where it was not intended from the start to use such a clamp to ameliorate this problem the clamping means 30 and boss 36 could be cut open so that the cord 16 could be removed from the boss 36 and clamping means 30 without severing the end connectors of cord 16. The limited flexibility of the material of clamping means 30 and boss 36 is relied on both to allow removal and installation of cord 16.

SUMMARY OF THE INVENTION

The present invention overcomes the difficulties noted above with respect the prior art devices described and in particular provides a clamp of the type shown and described the aforesaid '463 patent but which eliminates the problems noted with respect thereto.

The elongated body with two long side walls is retained, as is the first end abutment wall. The second end abutment wall is changed as is the clamping means which cooperates with said second end abutment wall. The solid top section of the second end abutment wall is altered to make it a selectively latched, selectively positioned releasable member. The releasable member has a curved body to conform to the shape of the clamping member and is pivotally coupled at one end to the second end abutment wall and at the second end has a releasable latch by which it is coupled also to the second end abutment wall. In a first position the releasable member seals the second end abutment wall so that the clamping means is trapped within but free to rotate, its external thread mating with the internal threads on the lower portion of the second end abutment wall. The second position of the releasable member permits the clamping means to be installed in or removed from the second end abutment wall.

The installation or removal of an electrical cord from the clamping member is greatly simplified by making the body portion and clamping means of the clamping member as split sections, each section being half of the clamping member along the longitudinal axis and joining the two halves by a hinge and releasable latch. A pin and mating aperture, guide the proper assembly of the halves about a cord therein. The clamp body is held in assembly at its other end by the boss an releasable member. It is an object of this invention to provide an improved clamp to retain in assembly mated male and female electrical connectors.

It is another object of the invention to provide an improved clamp which can be applied to already mated electrical connectors to retain them in assembly.

It is yet another object of the invention to provide a clamp to hold in assembly mated male and female connectors which is adjustable to the size of the connectors used.

It is still another object of the invention to provide a clamp to hold in assembly mated male and female connectors which do not apply any forces to the electrical cords connected to such connectors.

It is an object of this invention to provide a clamp where both of the cords installed to the connectors can be removed without disassembly of the of the cord/-connector arrangement.

It is yet another object of the invention to provide a cord gripping device which can be independently removed from the cord without disassembly of the cord and its connector.

Other objects and features of the invention will be pointed out in the following description and claims and illustrated in the accompanying drawings, which disclose, by way of example, the principles of the invention, and the best mode which has been presently contemplated for carrying it out.

BRIEF DESCRIPTION OF THE DRAWING

In the drawings in which similar elements are given similar references characters.

DESCRIPTION OF THE PREFERRED EMBODIMENT

Figure 1:
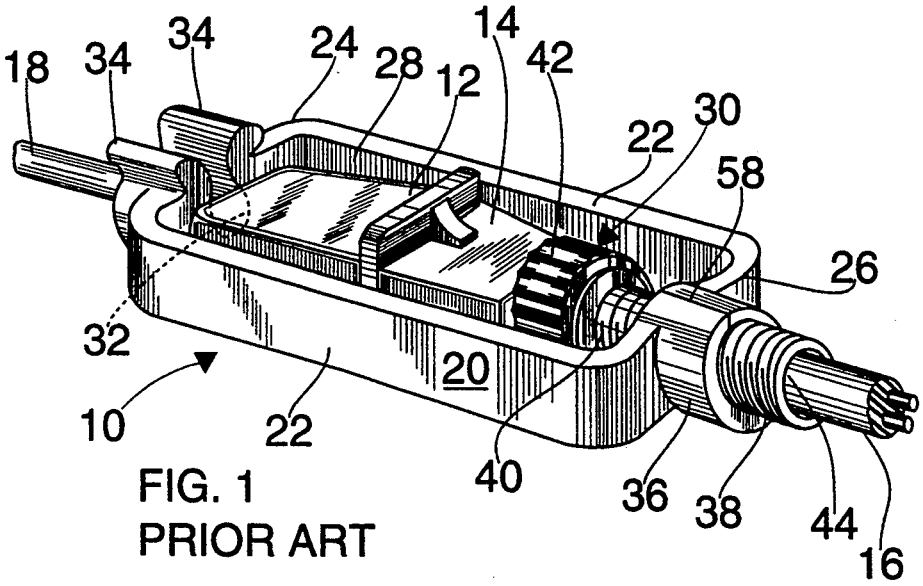
FIG. 1 PRIOR ART
FIG. 1 is a perspective view of an embodiment of the clamp of prior art U.S. Pat. No. 4,664,463 and is FIG. 1 of such patent.

Turning now to FIG. 1 which is FIG. 1 of the aforemented U.S. Pat. No. 4,664,463 issued May 12, 1987 there is shown the basic clamp structure over which the instant invention is a great improvement. A plug and connector clamp 10 maintains in engagement engaged electrical plug 12 and female or socket connector 14 carried by electrical cords 18 and 16 respectively. The clamp 10 preferably is made of any suitable, insulating, moldable plastic material which will give clamp 10 some degree of resilience and flexibility. A housing 20 is made up of a pair of laterally spaced apart sides 22, and a first and second end abutments 24 and 26, which together define an elongated neutral space 28 for receiving the engaged plug 12 and connector 14 which are constrained by the sides 22 against sideways movement in the general plane within which plug 12, connector 14 and sides 22 lie. All corners formed by the sided and end abutments are rounded and smooth to prevent possible snagging of the clamp 10 on objects in the work area.

In a properly secured position within the central space 28, the plug 12 engages the first end abutment 24 and a clamping means 30 carried by the second end abutment 26 engages the connector 14, urging it against the plug 12 to maintain the integrity of the interconnection.

The first end abutment includes a cord opening 32 adopted to receive the cord 18. the opening is characterized by a narrowed entry throat which is defined by a pair of confronting cord guides or retainers 34. the limited flexibility of the material of the clamp 10 allows the cord 18 to be pressed into the cord opening 32 by outwardly deflecting the retainers 34. However, the flexibility is not enough to allow the cord 18 to be pulled outwardly past the retainers 34 without a significant or deliberate effort.

The second end abutment 26 is characterized by an integral boss 36 having an internally threaded clamp opening 38 through which clamping means 30 extends. The clamping means 30 includes a shank, or externally threaded clamp portion 40 threadably carried within the clamp opening 38, and further includes an enlarged diameter portion or thumb wheel 42 integral with the clamp portion 40 and operable to rotate the clamping means 30. The clamping means 30 also includes a central bore or cord opening 44 which axially, slidably receives the connector cord 16.

The housing 20 is preferably of unitary construction and permanently mounted to the cord 16. This is done by molding the connector 14 to the cord 16, locating the connector 14 within the central space 28, and then leading the cord 16 out through cord opening 44 for connection to a male plug, cord reel or the like. In order that the connector 14 and cord 16 be selectively installed to or removed from the clamp 10, it is necessary to cut or slit through the end abutment boss 36 and the clamping means 30 as shown at 58. The limited flexibility of the clamp material enables the slit components to be pried apart sufficiently to enable the cord 18 to be laterally inserted through the slit 58 into the cord opening 44 or removed therefrom.

Turning now to FIGS. 2 to 7 a clamp 100 instructed in accordance with the concepts of the invention is shown. Clamp 100 has a housing 102 made up of two generally elongated sides 22 and a first end abutment wall 24 which contains cord opening 32 flanked by two confronting cord guides or retainers 34 all as is found in clamp 10 of FIG. 1.

The central space 28, in which are contained plug 12 and female connector 14, is closed by second end abutment wall 104. Second abutment wall 104 (see FIG. 4) is made up of a base portion 106, two short, upstanding walls 108 and 110 and a releasable member 112. The base portion 106 is generally arcuate in shape and together with releasable member 112, which is also arcuate in shape in its central portion 114, defines a complete circular passage 116 through the second end abutment wall 104. A series of raised helically oriented teeth 118 extend upwardly into the circular passage 116 to engage the complementary exterior teeth of the shank or body of the clamping member to be described below. The teeth 118 also extend half-way up the interior surface of the walls 109, 110. Releasable member 112 has a central portion 114 and fillets 120 and 122 flanking central portion 114 to provide a continuous flat interior surface which permits the teeth of the shank of the clamping member to turn in engagement with teeth 118 of the second end abutment wall 104.

Figure 2:
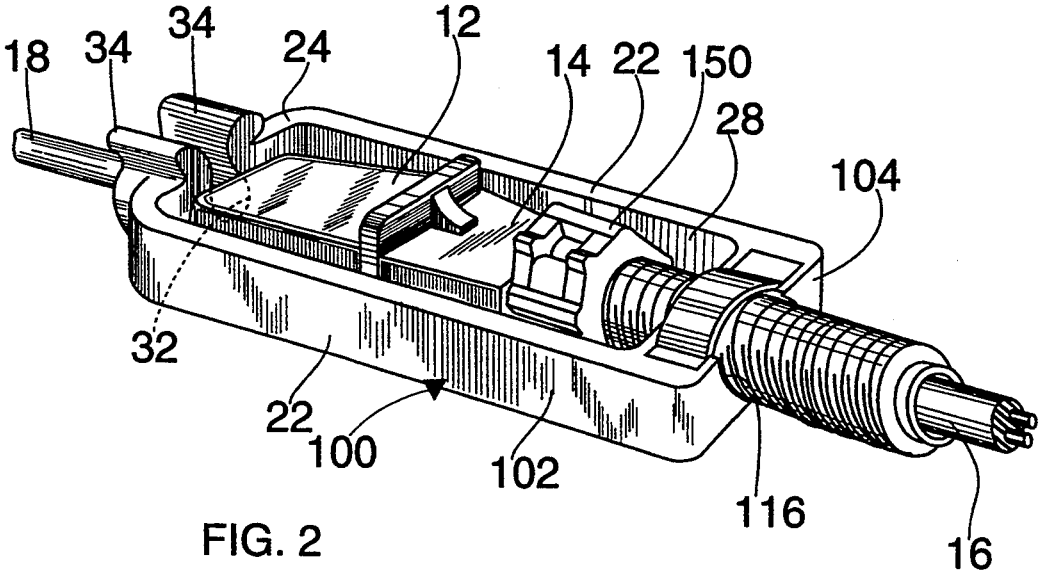
FIG. 2 is a perspective view of a clamp constructed in accordance with the concepts of the invention and showing the clamp applied to mated electrical plug and female socket connectors with attached electrical cords.
Figure 3:
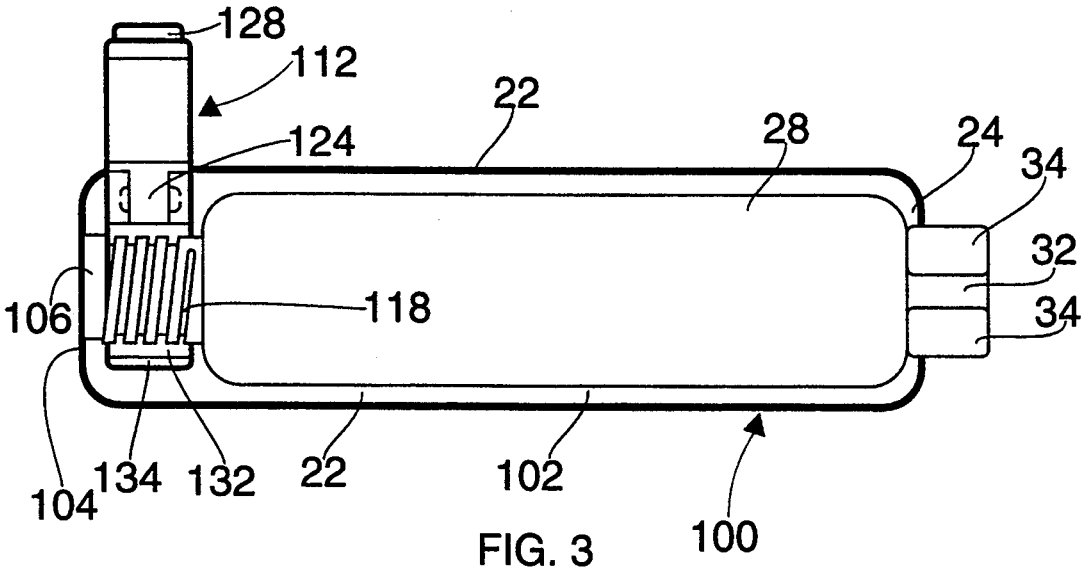
FIG. 3 is a top plan view of the clamp body with the releasable member of second end abutment wall in its open position.
Figure 4:
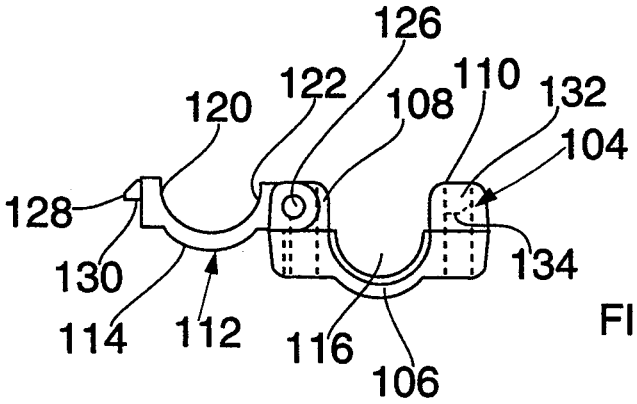
FIG. 4 is an end view of the clamp body of FIG. 3.

A tab 124 extends from one end of releasable member 112 and has a bore therethrought to receive a pivot pin 126 anchored in wall 104 which permits releasable member 112 to pivot from the fully open position in FIG. 4 to the closed position in FIG. 2. A latch member 128 on the other end of releasable member 114 has a shoulder 130 positionable in aperture 132 and against stop 134 to hold the releasable member 112 in the closed position. A thin tool, such as a screw driver blade can be inserted into aperture 132 to release latch member 128 permitting the releasable member 112 to be returned to its open position at which time the clamp member can be inserted or removed as desired.

Figure 5:
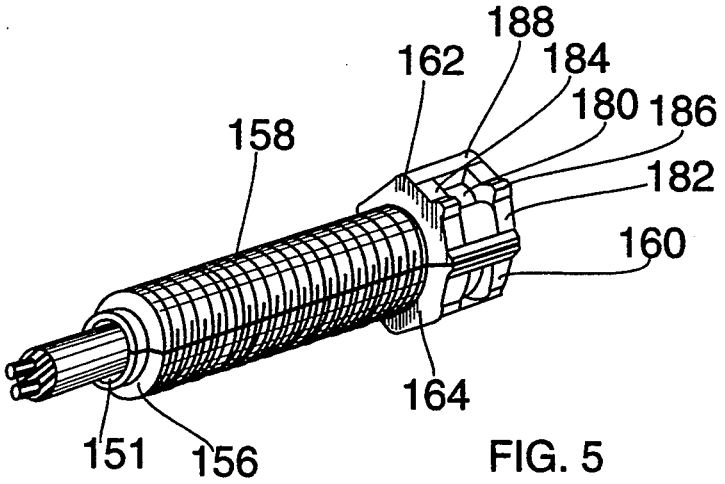
FIG. 5 is a perspective view of the clamping member of the clamp of FIG. 2.
Figure 6:
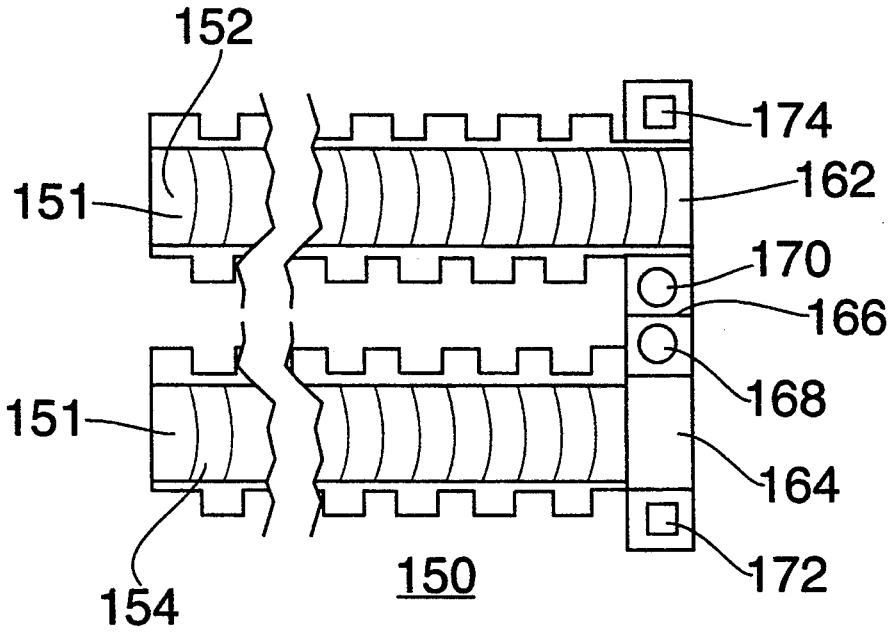
FIG. 6 is a top plan view of the clamping member of FIG. 5. fully open to show the guiding and locking member positions.
Figure 7:
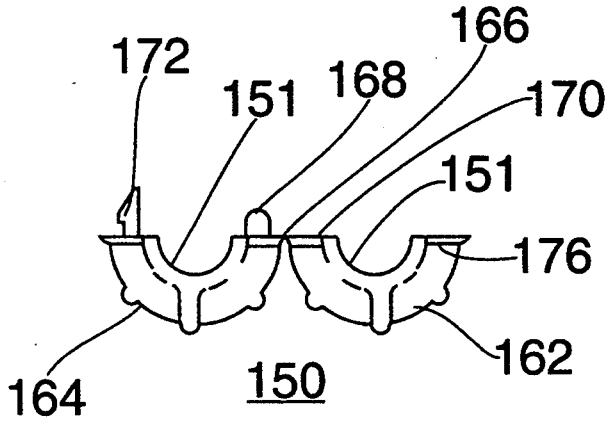
FIG. 7 is a front electrical view of the open clamping member of FIG. 6.

As best seen in FIGS. 5 to 7 the clamping means 150 has a body made up of two mating halves 152 and 154 which when closed, as will be described below, provides an elongate cylindrical body or shank portion 156 having a series of external, belically arranged teeth 158 which mate with the teeth 118 of second end abutment wall 104, and a central bore 151 therethrough. Integral with halves 152 and 154 are halves 162 and 164 of the clamping portion 160 which are joined by living hinge 166.

A pin 168 on half 164 engages aperture 170 on half 162 to align the halves 162, 164 when the two are closed and to maintain alignment of the halves 162, 164 in use. A latch 172 on half 164 enters an aperture 174 on half 162 and engages stop 176 to lock halves 162, 164 together about an electrical cord placed within clamping means 150.

To use clamp 100 with a male plug connector 12 and an engaged female or socket connector 14 the following procedure is followed. The male plug 12 is placed in central space 28 and its cord 18 is pressed between the retainers 34 into cord opening 32. Plug 12 is installed so that its shoulders, adjacent cord 18, are in intimate contact with the inner surface of first end abutment wall 24.

A clamping means 150, open as shown in FIGS. 6 & 7 is placed about the cord 16, which is already attached to female or socket connector 14, which extends within bore 151. The free ends of the halves 152, 154, 162 and 164 are rotated towards each other bringing alignment pin 168 on half 164 into engagement with alignment aperture 170 in half 162. Finally when bore 151 encircles cord 16, the latch 172 on half 164 enters aperture 174 in half 162 and latches to shoulder 176 preventing accidental separation of the halves. The completed clamp means 150 can now be freely moved along cord 16 so that it can be aligned and positioned to mate with the threaded portion of second end abutment wall 104. The exterior of halves 162, 164 can be made solid with a series of ridges thereon as shown by FIG. 1 or made up of a central hub 180 with flanges 182, 184 flanking it and having a periphery made up of raised ridges 186 on each flange 182, 184 or ridges 188 that span both flanges 182, 184. The female connector 14 is now mated with plug 12, and the clamping means 150 is placed with the clamping portion 160 made up of halves 162, 164 placed against the back of connector 14 adjacent cord 16. The shank 156 is placed in bore 116 of second abutment wall 104 and the releasable member 114 is closed over shank 156 and latched by engaging shoulder 130 of latch member 128 with stop 134 in aperture 132. The clamping member 150 can now be rotated until the clamping portion 160 is against the cord end of connector 14 and the plug 12, engaged with connector 14 is against first end abutment wall 24.

To rapidly separated connectors 12 and 14 it is only necessary to open releasable member 112 and remove clamping means 150. The clamping means 150 can also be released if desired.

While there have been shown and described and pointed out the fundamental novel features of the inventions as applied to the preferred embodiment, it will be understood that various omissions and substitutions and changes of the form and details of the device illustrated and in its operation may be made by those skilled in the art, without departing from the spirit of the invention.

The embodiment of the invention in which an exclusive property or privilege is claimed are defined as follows:

1. A plug and socket connector clamp for maintaining engagement between an engaged electrical plug and electrical socket connector each terminating an electrical cord, said clamp comprising:

a housing including spaced apart sides and first and second end abutments defining an elongated central space for receiving said engaged plug and socket connector, said sides being adapted to constrain said plug and socket connector against sideway movement in at least one plane, and said first end abutment is adapted to engage said engaged plug and socket connector, said first and second end abutments including a first cord opening and a clamp opening, respectively;

clamping means extending through said clamp opening and including a second cord opening and a clamp portion longitudinally movable against said engaged plug and socket connector in said central space to hold said engaged plug and socket connector between said first end abutment and said clamp portion and thereby constrain said plug and socket connector against longitudinal separation; and said second end abutment further comprising a releasable member capable of being moved from a first position partially defining said clamp opening to a second position where said releasable member no longer defines said clamp opening; said clamping means capable of direct insertion into said clamp opening when said releasable member is in said first position and can not be removed from said clamp opening when said releasable member is in its second position.

2. A plug and socket connector clamp as defined in claim 1 wherein said releasable member has a first end and a second end and a curved body therebetween said body together with the remainder of said second end abutment defining a circular clamp opening.

3. A plug and socket connector clamp as defined in claim 2 wherein one of said first and second ends of said releasable member is pivotally mounted to said second end abutment and the other of said first and second ends of said releasable member has a releasable latch to lock said releasable member to said second end abutment when said releasable member is in its second position.

4. A plug and socket connector clamp as defined in claim 1, wherein said clamping means has a clamping body which terminates at one end in said clamp portion and said second cord opening is a bore through said entire clamping means; and an external screw thread on the exterior surface of clamping body.

5. A plug and socket connector clamp as defined in claim 4, wherein the portion of said second end abutment other than said releasable member is internally screw threaded to receive therein the external complementary screw threads up said clamping body of said clamping means to permit said clamp portion to be longitudinally movable against or away from said engaged plug and socket connector in said central space.

6. A socket connector clamp as defined in claim 4, wherein said clamping means clamping body and clamp portion are each comprised of two sections held together by a hinge between said two sections of said clamp portion, said two sections of said clamping body and clamping portion having a first open position wherein an electrical cord connected to one of said plug and socket connectors can be placed in said second cord opening or removed therefrom and a second closed position wherein an electrical cord can not be inserted or removed from said second cord opening.

7. A plug and socket connector clamp as defined in claim 6, wherein said clamping means further includes a releasable latch on one of said clamp portion's two sections and a socket on the other of said clamp portion's two sections to permit said two clamp portion sections and said two clamp body sections to form a complete clamping means which encircles the portion of an electrical cord placed in said clamp means.

8. A plug and socket connector clamp as defined in claim 7, wherein said clamp portion further includes a positioning pin on one clamp portion section and a recess in the other clamp portion section to receive said positioning pin to help align said clamp portion sections when said clamping means is closed about an electrical cord.

9. A plug and socket connector clamp as defined in claim 1, wherein said clamp portion comprises a central hub having a first end and a second end; two spaced apart flanges, one at each of said first end and second end of said hub and a plurality if raised projection on the periphery of said flanges to assist in rotating said clamp portion.

10. A plug and socket connector clamp as defined in claim 9, wherein certain of said projections on one flange are joined to associated projections on said second flange to form continuous walls between said two flanges to improve the ability to grip and rotate said clamp portion.

* * * * *